United States Patent [19]

Werner

[11] Patent Number: 4,819,466

[45] Date of Patent: Apr. 11, 1989

[54] CLOSURE MECHANISM FOR A CASE

[75] Inventor: Hans U. Werner, Solingen, Fed. Rep. of Germany

[73] Assignee: S. Franzen Sohne (GmbH & Co.), Solingen, Fed. Rep. of Germany

[21] Appl. No.: 111,806

[22] Filed: Oct. 23, 1987

[30] Foreign Application Priority Data

Nov. 5, 1986 [DE] Fed. Rep. of Germany ..... 3637698

[51] Int. Cl.[4] ..... E05B 65/62

[52] U.S. Cl. ..... 70/70; 70/312; 292/179; 292/113

[58] Field of Search ..... 70/67, 69, 70, 71, 72, 70/73, 74, 75, 76, 312; 292/139, 150, 179, 113; 190/41 R, 56

[56] References Cited

U.S. PATENT DOCUMENTS 3,756,639 9/1973 Wilkinson ..... 70/70

3,961,505 6/1976 Gehrie et al. ..... 70/66

4,679,833 7/1987 Dueringer ..... 292/113

*Primary Examiner*—Robert L. Wolfe

*Attorney, Agent, or Firm*—Burns, Doane, Swecker & Mathis

[57] ABSTRACT

A case comprises a pair of sections, one of which carries a hasp and the other of which carries a closure mechanism. The closure mechanism includes a hasp-receiving zone for receiving the hasp in a first direction, and a closure element for engaging and retaining the hasp in a terminal position in the hasp-receiving zone. The closure element is rotatably mounted on a pivot axle, and the pivot axle is movable in a second direction substantially parallel to the first direction. The closure element pivots on the pivot axle between a first position permitting the hasp to enter the zone, and a second position in which the hasp enters a recess in the closure element. By rotating an actuating lever, the closure element is moved to a third position retaining the hasp in a terminal position in the zone.

25 Claims, 17 Drawing Sheets

CLOSURE MECHANISM FOR A CASE

BACKGROUND OF THE INVENTION

The invention relates to a closure mechanism for cases such as suitcases, bags or the like wherein the case comprises a pair of hinged sections that can be swung open and closed. One of the sections carries a hasp and the other section carries a closure mechanism for engaging the hasp in response to actuation of an actuating handle.

Such closure devices are known (e.g., see U.S. Pat. No. 3,961,505) wherein the closure mechanism includes a closure element which is slidable in a direction parallel to a front wall of the case and perpendicular to the direction in which the hasp is to be displaced toward a secured position in the second case section. The closure element, which is displaced by a rotatable actuating lever, contains an inclined surface which engages a projection of the hasp. In the event that the case is full so that the hasp does not reach a terminal position of securement when the case sections are initially brought together, it is necessary for the inclined surface to cam the hasp toward a secured position as the actuating lever is rotated. As a result of such an arrangement, only a fraction of the forces applied by the closure element against the hasp are applied in the direction of hasp movement, thereby requiring that considerable force be applied to the actuating lever by the user.

Furthermore, in some cases a gasket is provided on one of the case sections for engagement by a rib on the other section, in order to effect a water-tight seal. If, due to the need for excessive closing forces, the hasp is not brought to its terminal position of securement, a tight seal may not be formed.

SUMMARY OF THE INVENTION

In accordance with the present invention, a case comprises a pair of closable sections. A hasp is mounted on a first of the sections, and a closure mechanism is mounted on a second of the sections for acting on the hasp to secure the sections closed. The closure mechanism comprises means defining a hasp-receiving zone, and a closure element mounted for movement between first, second, and third positions. In its first position, the closure element enables the hasp to enter the zone in a first direction of travel. In the second position of the closure element, a drawing surface thereof overlaps and engages a portion of the hasp. In its third position, the closure element retains the hasp in a terminal position of securement in the hasp-receiving zone. Manually actuable means is provided for displacing the closure element from the first position to the third position in a second direction substantially perpendicular to the first direction.

Preferably, the closure element is rotatable on a pivot axle for movement between its first and second positions. The axle is displaceable between positions corresponding to the second and third positions of the coupling element. The pivot axle is constrained for movement in the second direction. The manually actuable means is operably connected to the pivot axle for effecting displacement thereof.

Preferably, the pivot axle is guided for linear reciprocation in a stationary slot. A linearly displaceable slide is provided. A control lever is pivotably mounted between the slide and the pivot axle so that displacement of the slide causes the pivot axle to be displaced in the slot. The manually actuable means comprises a pivotably mounted actuating lever which is displaceable between open and closed positions and is arranged to displace the slide in response to being closed, whereby the closure element is displaced from its second position to its third position.

The invention also relates to the closure mechanism per se.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF PREFERRED EMBODIMENTS OF THE INVENTION

Figure 1:
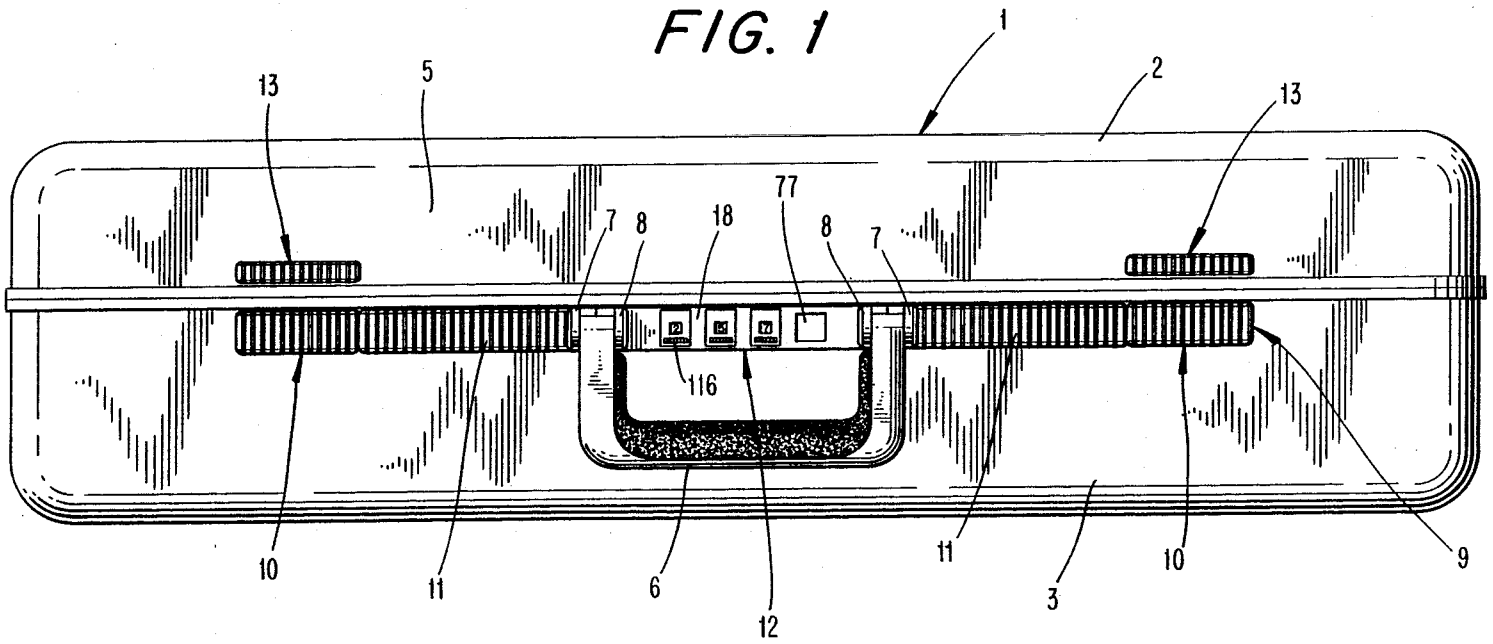
FIG. 1 is a top plan view of a case containing a closure mechanism in accordance with the present invention.

A case 1 depicted in FIG. 1 includes upper and lower sections 2, 3 adapted to be secured together by a mechanism according to the present invention. The sections 2, 3 can be formed of any suitable material such as aluminum for example, and can be hingedly joined together.

One of the sections 3 carries a console 9 to which is mounted a carrying handle 6. The console 9 comprises a pair of closure mechanisms 10 and a permutation lock 12 located between the closure mechanisms 10 for selectively preventing the closure mechanisms from being opened. The closure devices 10 function to retain a pair of hasps 13 carried by the other case section 3.

Side and Center Plates

Figure 8:
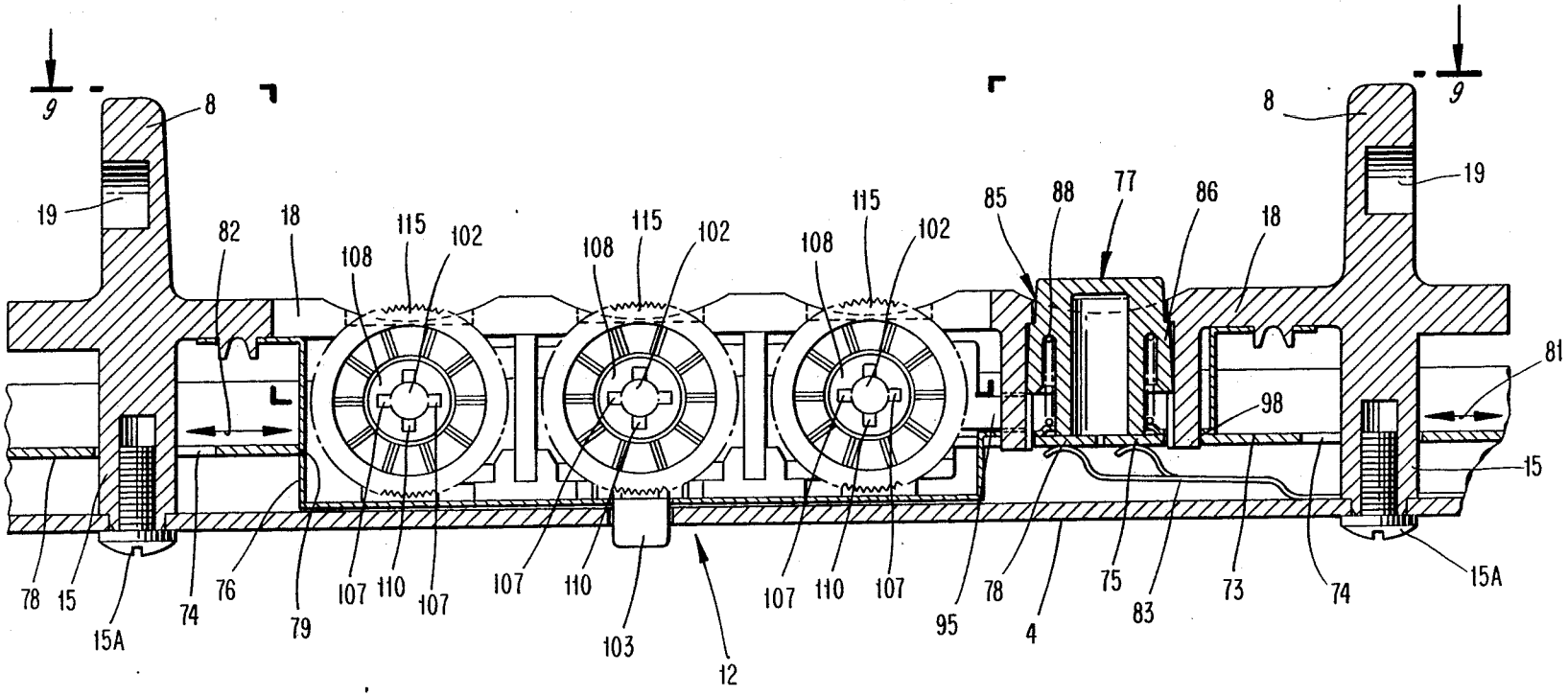
FIG. 8 is a sectional view taken through a center plate of the closure mechanism, with the tie rods secured to the center plate and the bolt of the permutation lock oriented to prevent displacement of the push button.

The closure devices 10 are carried by a pair of side plates 11, and the lock 12 is carried by a center plate 18 disposed between the side plates. Those side and center plates 11, 18 form part of the console 9. Each of the side plates 11 carries a pillow block 7, and the center plate 18 carries a pair of pillow blocks 8 located opposite respective ones of the pillow blocks 7. Each pair of associated pillow blocks 7, 8 presents opposing bores 17, 19 (see FIGS. 2 and 8) which receive a pivot pin for pivotably mounting the handle 6.

The console 9 is fixedly secured to a rigid channel-shaped frame 4 which is spaced inwardly from and extends parallel to a front wall 3A of the case section 3. Securement of the console is effected by means of a plurality of posts 15 which are formed integrally with the side plates 11 and the center plate 18 (see FIG. 2). The posts extend to the frame 4 and are internally threaded to receive screws 15A which pass through openings in the frame 4.

Closure Mechanism

Figure 2:
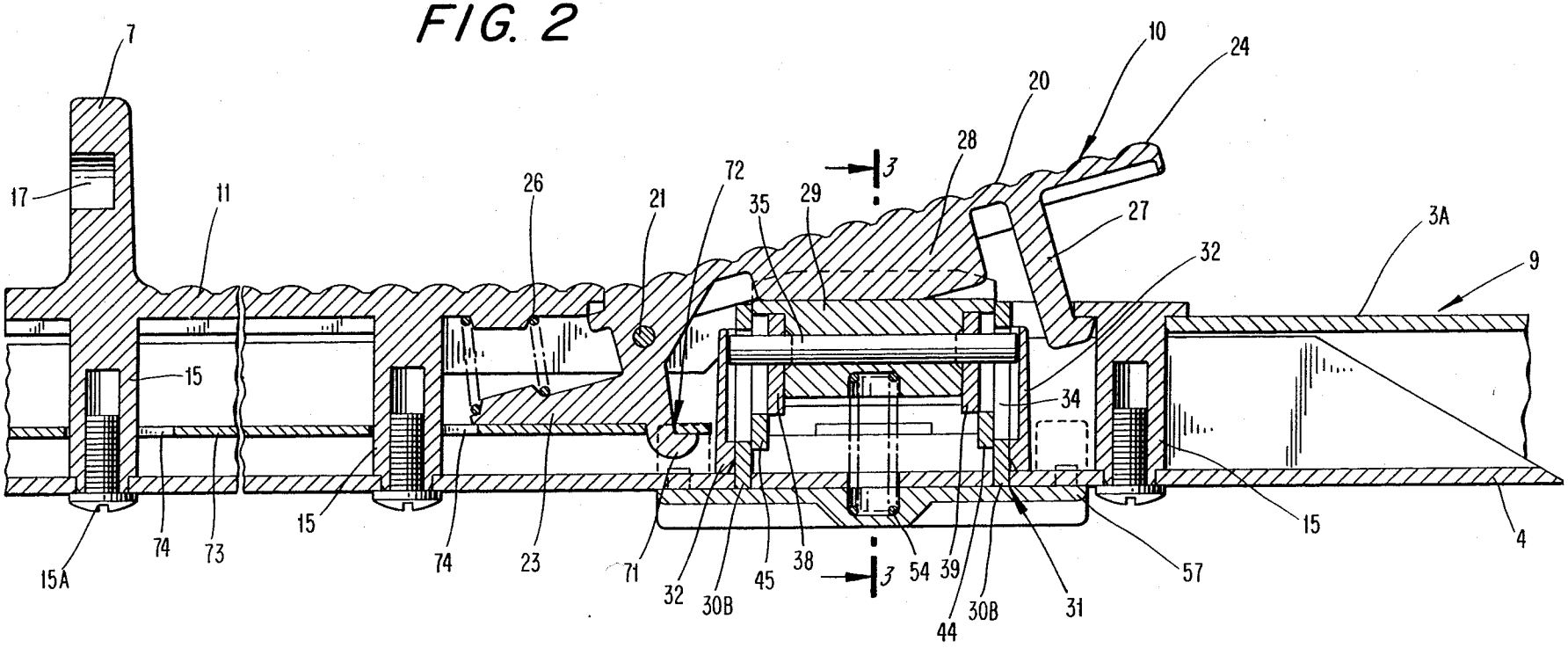
FIG. 2 is a sectional view taken through a side plate of the closure mechanism, depicting an actuating lever in an open position.

Since the two closure mechanisms 10 are basically of the same construction, only one will be described in detail hereinafter. Each closure mechanism 10 comprises an actuating lever 20 which is pivoted to an associated side plate 11 by a pivot pin 21 so that a gripping section 24 of the lever 20 can swing toward and away from the front wall 3A of the case section 3. The lever 20 includes an extension 23 which is continually biased by a coil compression spring 26 in a direction urging the gripping section 24 away from the front wall 3A to a lever-open position as depicted in FIG. 2. The spring 26 acts between the lever extension and the side plate 11. The extent to which the lever 23 can be swung open is limited by engagement between the side plate 11 and a stop shoulder 27 of the lever.

Swinging of the lever 23 to an open position occurs in response to the steps of: (1) placing the permutation lock in an on-combination condition, and (2) subsequently depressing a button 77 (FIGS. 1, 8) as will be explained subsequently. Movement of the lever 23 to its open position produces a release of the associated hasp 13 by means of a force-transfer mechanism mounted on the console 9. That force-transfer mechanism includes an actuator slide 29 which has a slot 30 formed therein to receive a plate portion 28 of the lever 23 (see FIGS. 3–5). The slide 29 is slidably mounted in an opening 37 of a framework defined by stationary support plates 30A, 32 which are fastened to the frame 4. The slide 29 carries a transverse pin 33, both ends of which extend beyond the slide and are seated in slots 34 formed in side walls 30B of the support plate 30A (see FIG. 2). The slots 34 are oriented to permit the slide 29 to reciprocate in a direction perpendicularly relative to the front wall 3A of the case section 3. Thus, when the lever 20 is swung to its closed position, it pushes the slide inwardly, i.e., away from the front wall 3A. This movement of the slide is yieldably opposed by a coil compression spring 54 which is mounted in holes 53, 55 of the slide 29 and frame 4, respectively.

Connected pivotably to the ends of the pin 33 are a pair of links 38, 39 which are rigidly interconnected by a bridge 37′ to form therewith a force-transmitting member 36. The links 38, 39 contain aligned bores 40 through which a pivot axle pin 41 extends. The ends of the pin 41 extend beyond the links 38, 39 and are slidably disposed within elongated slots 42 formed in the support plate 30A. Those slots 42 are oriented perpendicularly relative to the slots 34. Pivotably mounted on the ends of the pin 41 are a pair of legs 44, 45 which are rigidly interconnected by a web 47. Mounted on the web is a closure lug 48A which includes an aperture 48. The legs 44, 45, the web 47, and the lug 48A together define a closure element 46 which projects through an opening 51 in the frame 4.

It will be appreciated from the foregoing that when the slide 29 is pushed inwardly by a closing of the actuating lever 20, the pin 41 is constrained to travel in the slot 42 in a direction inwardly through the opening 51 as the links 38, 39 rotate about the pin 33. Hence, the closure element 46 is retracted away from the opening 51 along with the pin 41. Conversely, when the actuating lever 20 swings open so that the slide 29 is pushed outwardly by the spring, the pin 41 travels toward the opening 51 whereby the closure element 46 is extended outwardly through the opening 51.

Each leg 44, 45 includes an arm 49 located to a side of the pin 41 opposite the apertured lug 48A. Each arm 49 includes a rounded support surface 50 which engages a shoulder portion 50′ of the plate 32 to cause the closure element to rotate (counterclockwise as viewed in FIG. 3) about the axis of pin 41 when the closure element is extended, thereby assuring that the free or lugged end of the closure element will be disposed in a proper location (i.e., to the left in FIG. 3) for permitting the hasp to enter a hasp-receiving zone in a direction D (FIG. 4). The pivot axle 29 of the actuating lever 10 is oriented parallel to the direction D.

Mounted within the framework 30A, 32 is a camming ledge 43 which includes an inclined surface 43A arranged to contact the closure element 46 as the latter is displaced away from the opening 51. In so doing, the closure element is cammed into rotation about the axis of the pin. Thus, when the lever 20 is swung closed, the closure element 46 is displaced away from the opening 51 and simultaneously rotated to a position wherein a drawing surface 48B of the aperture 48 overlies a portion of the hasp, as will be hereinafter explained in more detail.

The hasp-receiving zone is defined by a guide plate 57 attached to an external surface of the frame 4. That guide plate 57 includes a shoulder 58 formed by guide surfaces 59, 60 that are inclined inwardly toward the opening 51. Those surfaces define guide ramps for the hasp 13.

The Hasp

The hasp 13 is fastened to the case section 2 by a suitable fastener 61 (FIG. 4), which also secures a profile rail 62 to the section 2. The rail 62 includes a groove 63 in which a gasket 64 is retained. A correspondingly shaped rail 65 is secured to the case section 3 and includes a rib 66 which engages the gasket 64 when the case is closed, in order to create a water-tight seal.

The hasp 13 includes an arm 67 having a projection or hook 68 at its free end, and a leg 69 which engages against the rail 62 to rigidify the hasp 13.

Figure 4:
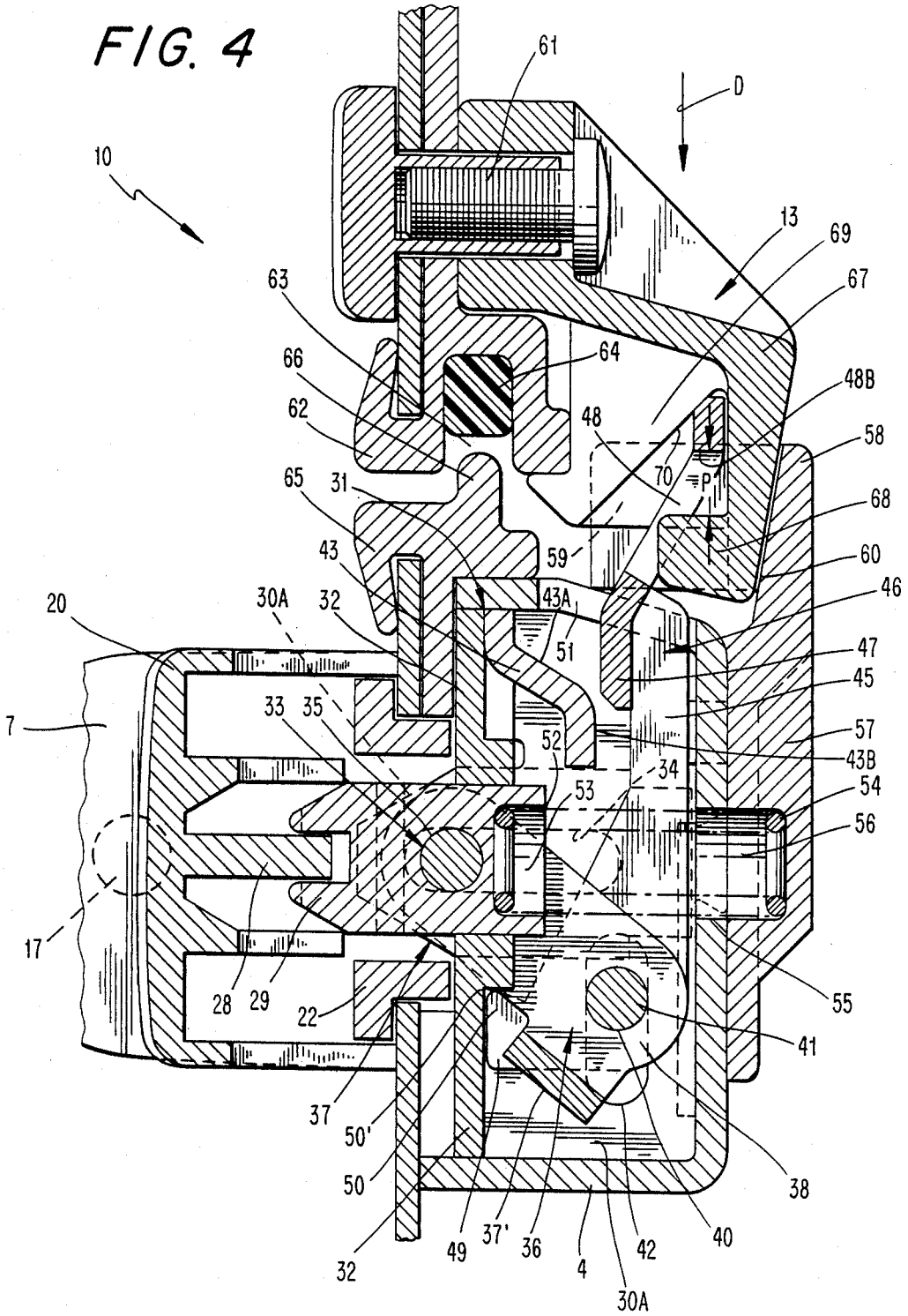
FIG. 4 is a view similar to FIG. 3 after the two sections of the case have been initially closed and the actuating lever has been partially closed to shift the coupling element to its second position.
Figure 5:
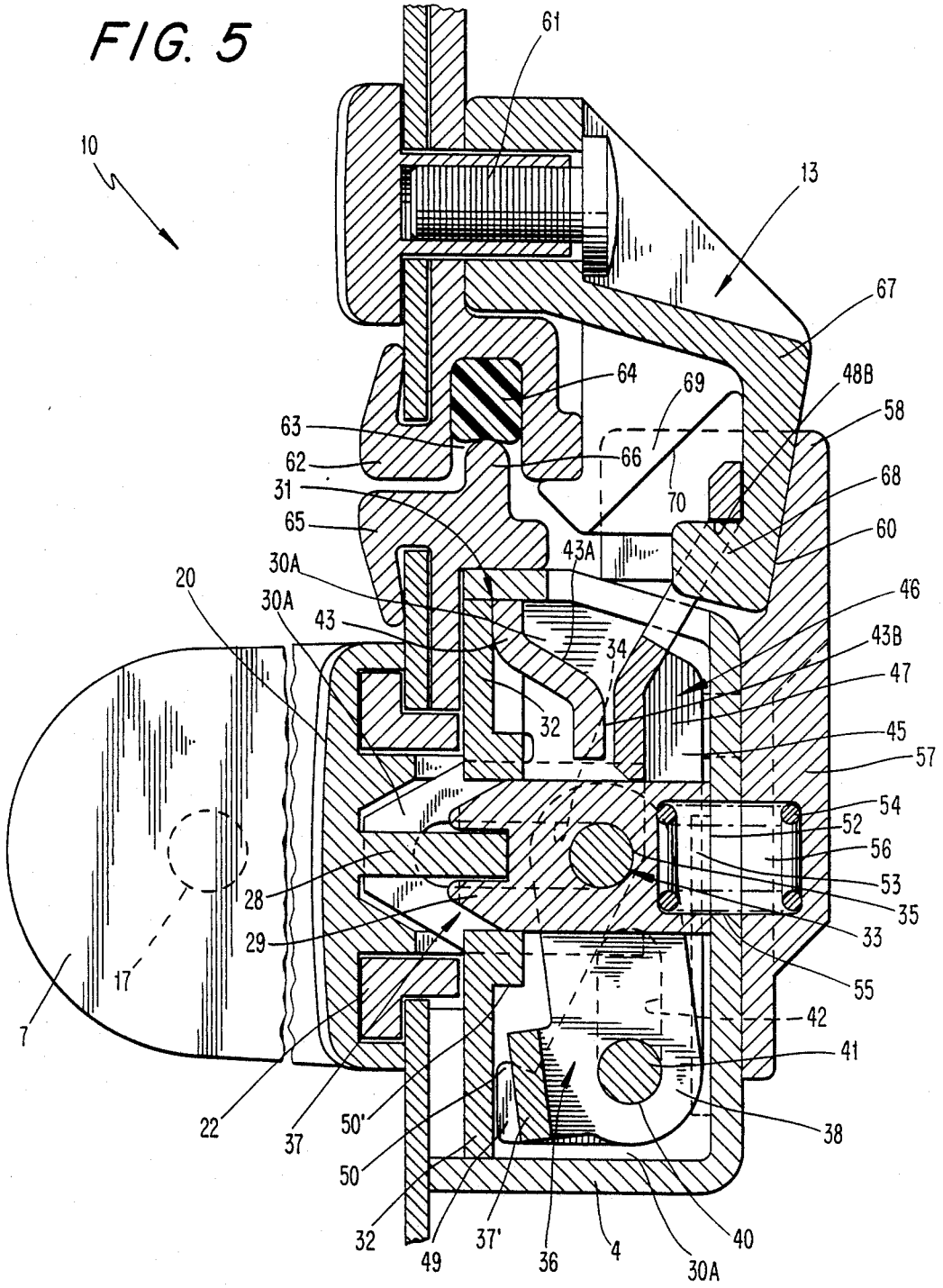
FIG. 5 is a view similar to FIG. 4 after the actuating lever has been fully closed, and the coupling element has been moved to a third position drawing the hasp to a terminal position within a hasp-receiving zone.
Figure 6:
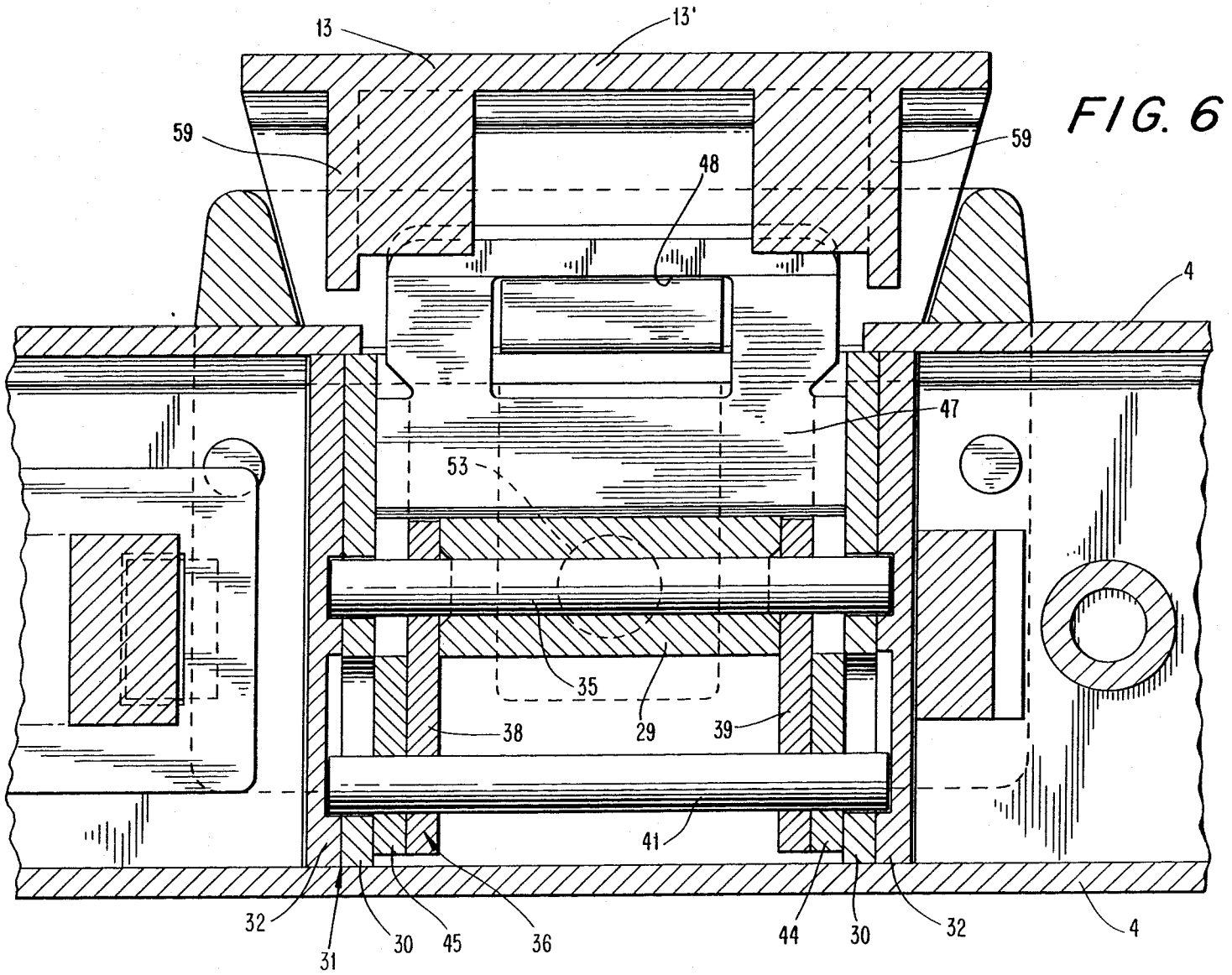
FIG. 6 is a sectional view taken along the line 6—6 in FIG. 7.
Figure 7:
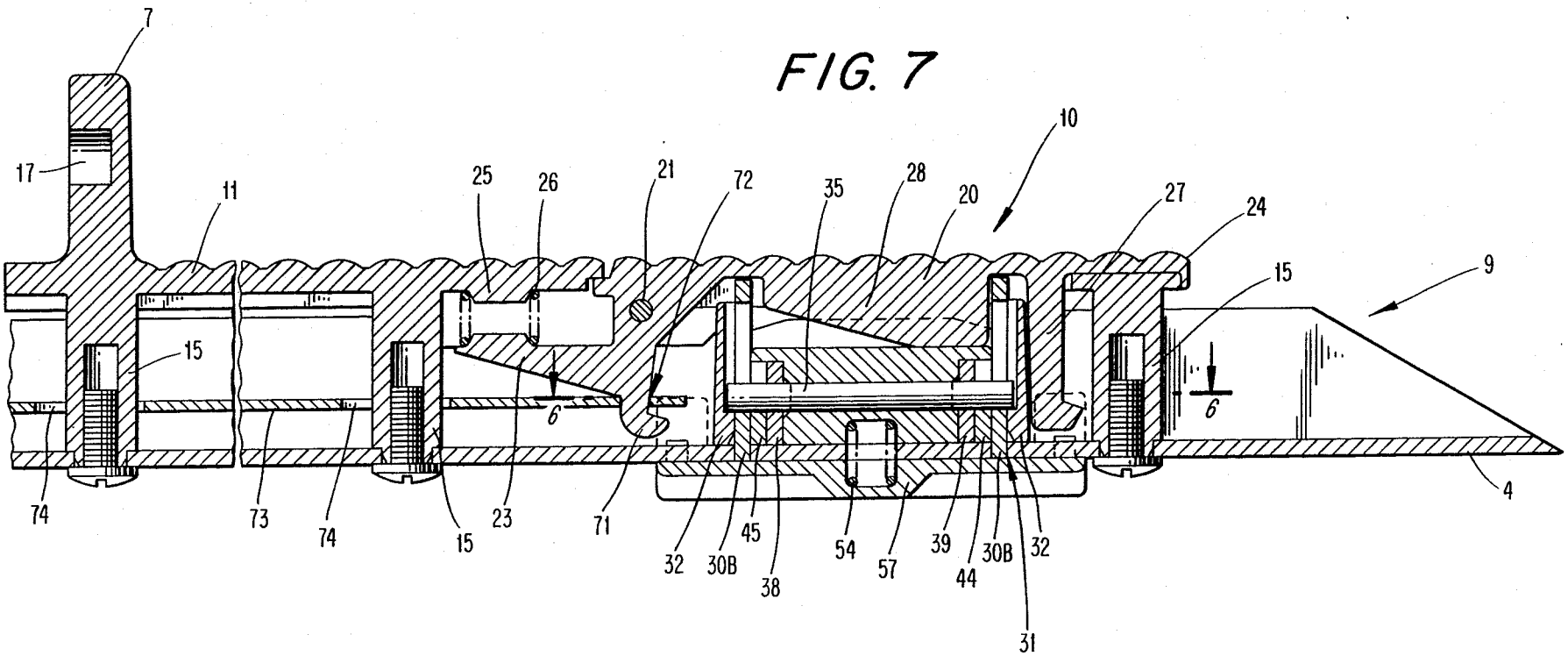
FIG. 7 is a sectional view similar to FIG. 2 after the actuating lever has been closed.

When the case sections are closed, the guide ramps 59, 60 of the guide plate 57 guide the arm 67 of the hasp into the hasp-receiving zone in a direction D (FIG. 4). Simultaneously, the camming ledge 43 engages the lug 48A and induces the closure element 46 to swing about the pin 41 to a hook-capturing position wherein the hook 68 of the hasp projects through the aperture 48. In that position, a drawing surface 48B of the aperture 48 overlaps or overlies the hook 68. The height H of the aperture 48 in the closure element 46 is greater than the corresponding height of the hook 68 of the hasp 13 to create an amount of play P (FIG. 4) between the hook 68 and a drawing surface 48B of the aperture 48, so that even if the case were so full that the hook 68 could not initially travel to a terminal position in the hasp-receiving zone, the closure element 46 could still capture the hook 68. If, thereafter, the actuating lever 20 is swung closed, causing the closure element 46 to be retracted inwardly, the drawing surface 48B of the aperture 48 will pull the hook 68 to its terminal position in the hasp-receiving zone (FIG. 5). In that position, a surface 43B of the ledge 43 prevents rotation of the closure member in a direction (counterclockwise in FIG. 5) which would release the hasp.

In accordance with the present invention, the slot 42, which defines the direction in which the closure element 46 is retracted, is oriented at least substantially parallel to the direction D in which the hook 68 travels to the terminal position in the hasp-receiving zone. Therefore, substantially all of the forces applied by the closure element 46 to the hasp will be directed in virtually the same direction in which the hasp is being displaced and thus provides for a high efficiency and effectiveness of those forces.

It may be desirable to provide the hasp with a camming ramp 70 (FIG. 4) to aid in inducing rotation of the closure element 46. Such a ramp could be used along with, or instead of the ledge 43, or not used at all (see FIG. 25). Also, the arrangement could be such that the drawing surface 48B makes engagement with the hook 68 when the closure element is first swung to its hook-capturing position, i.e., the play P is eliminated (see FIG. 25).

Tie Rods

As noted earlier, the actuating levers 20 cannot be swung open until the permutation lock 12 is in an on-combination condition, and the button 77 has been depressed. Those two steps will result in the release of a pair of movable tie rods 73, 78 which act as locking slides to normally hold the actuating levers 20 in their closed positions. The tie rods 73, 78 are associated with respective ones of the actuating levers 20. For example, the tie rod 73 is associated with the earlier described actuating lever 20 and is connected thereto by means of a hole 72 formed in one end of the tie rod which receives a hook portion 71 of the actuating lever 20 (see FIG. 2). An opposite end 75 of the tie rod 73 contains a recess 96 which is engageable with a retaining finger 98 of the center plate 18 (FIGS. 8 and 11) so as to be immovable. The tie rod 73 is in the form of a flat plate containing elongated slots 74 through which the posts 15 extend.

The other tie rod 78 functions similarly to the tie rod 73 and contains a recess 97 for receiving a retaining finger 99 of the center plate. The recess 97 is relatively large so as to permit a housing 76 of the permutation lock to project through the tie rod 78. The tie rods are biased toward the fingers 98, 99 by a leaf spring 83 which is fastened to the frame 4.

By depressing the button 77, the tie rods 73, 78 are pushed off the respective fingers 98, 99. As a result, the tie rods 73, 78 are able to travel toward their respective actuating levers 20 in the direction of arrows 81, 82 in FIG. 8, as the actuating levers 20 are swung open by the springs 26. The button 77, is however, prevented from being depressed except when the permutation lock 12 is in an on-combination condition as will be explained subsequently.

Center Plate and Push Button

The push button 77 is movably disposed in a channel 85 defined by an annular wall 100 of the center plate, from which wall 100 the fingers 98, 99 depend. The button 77 contains an annular groove in which a coil compression spring 88 is positioned. That spring 88 acts against the button 77 and a portion 89 of the lock housing 76 to bias the button to an outward, or extended position. The button 77 includes an annular shoulder 86 arranged to bear against a lip 91 of the channel 85 in order to retain the button within the channel. An annular projection 90 of the button 77 is adapted to push against the tie rods 73, 78.

Figure 10:
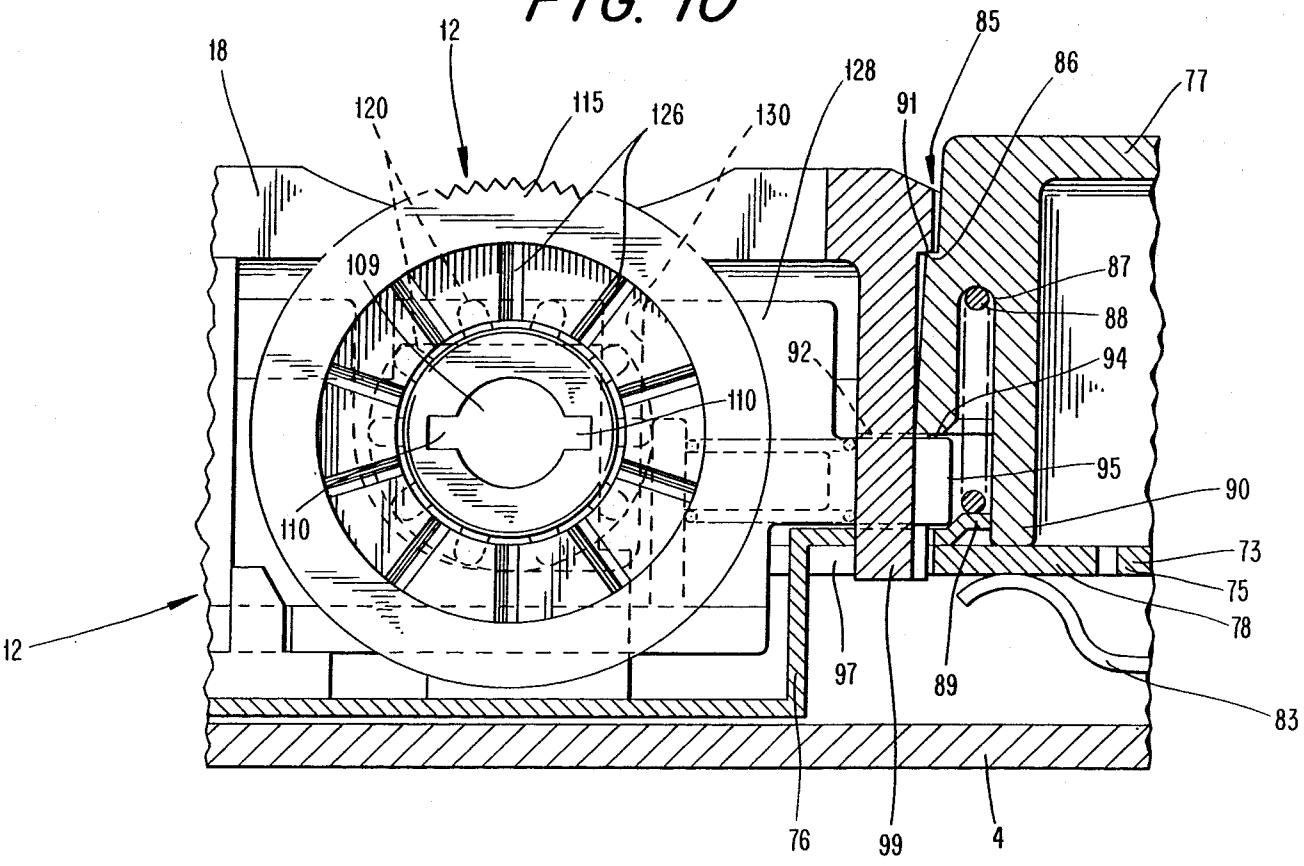
FIG. 10 is an enlarged fragmentary view of FIG. 8.
Figure 11:
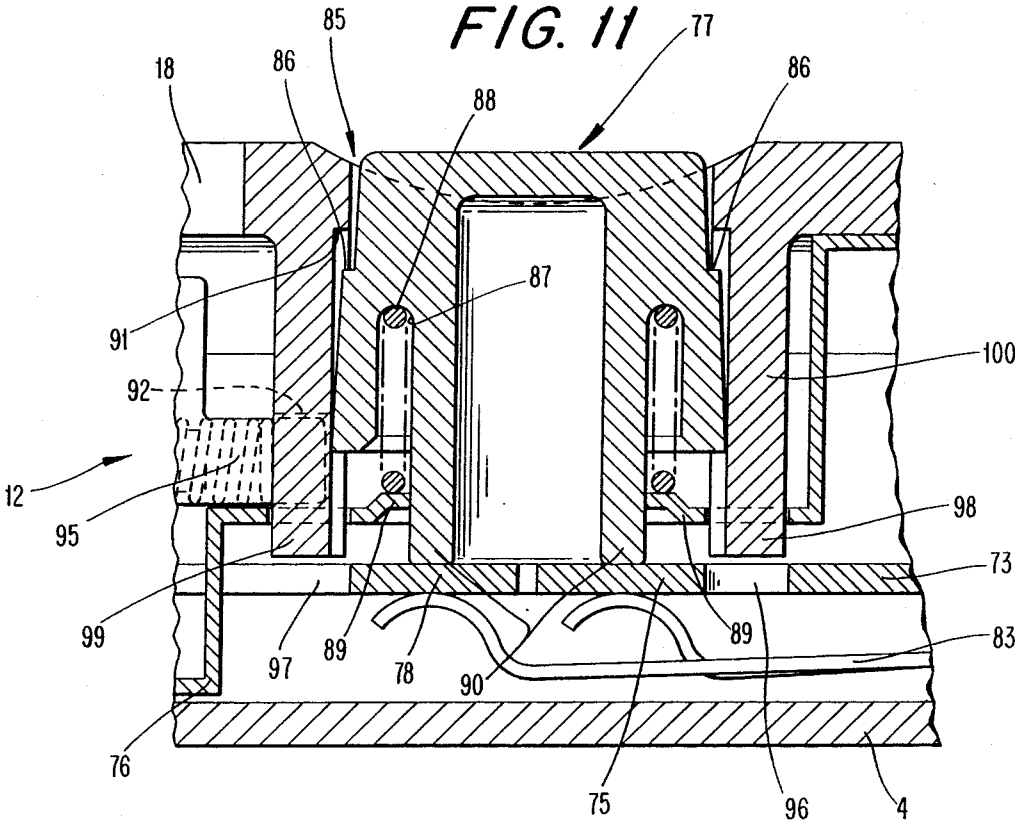
FIG. 11 is a view similar to FIG. 10 when the permutation lock is on-combination, and the push button has been displaced to disconnect the tie rods from the center plate.

The wall 100 of the center plate 18 includes a lateral through-passage 92 which opens into the channel 85. As will be explained subsequently, a finger 95 of the permutation lock is adapted to project through and beyond the passage 92 to prevent the button 77 from being depressed when the lock is off-combination, as depicted in FIG. 10. However, when the lock is on-combination, the finger 95 is retracted, as depicted in FIG. 11, to permit the button to be depressed.

Permutation Lock

The permutation lock 12 is disposed within the housing 76 which is secured to the center plate 18.

Figure 12:
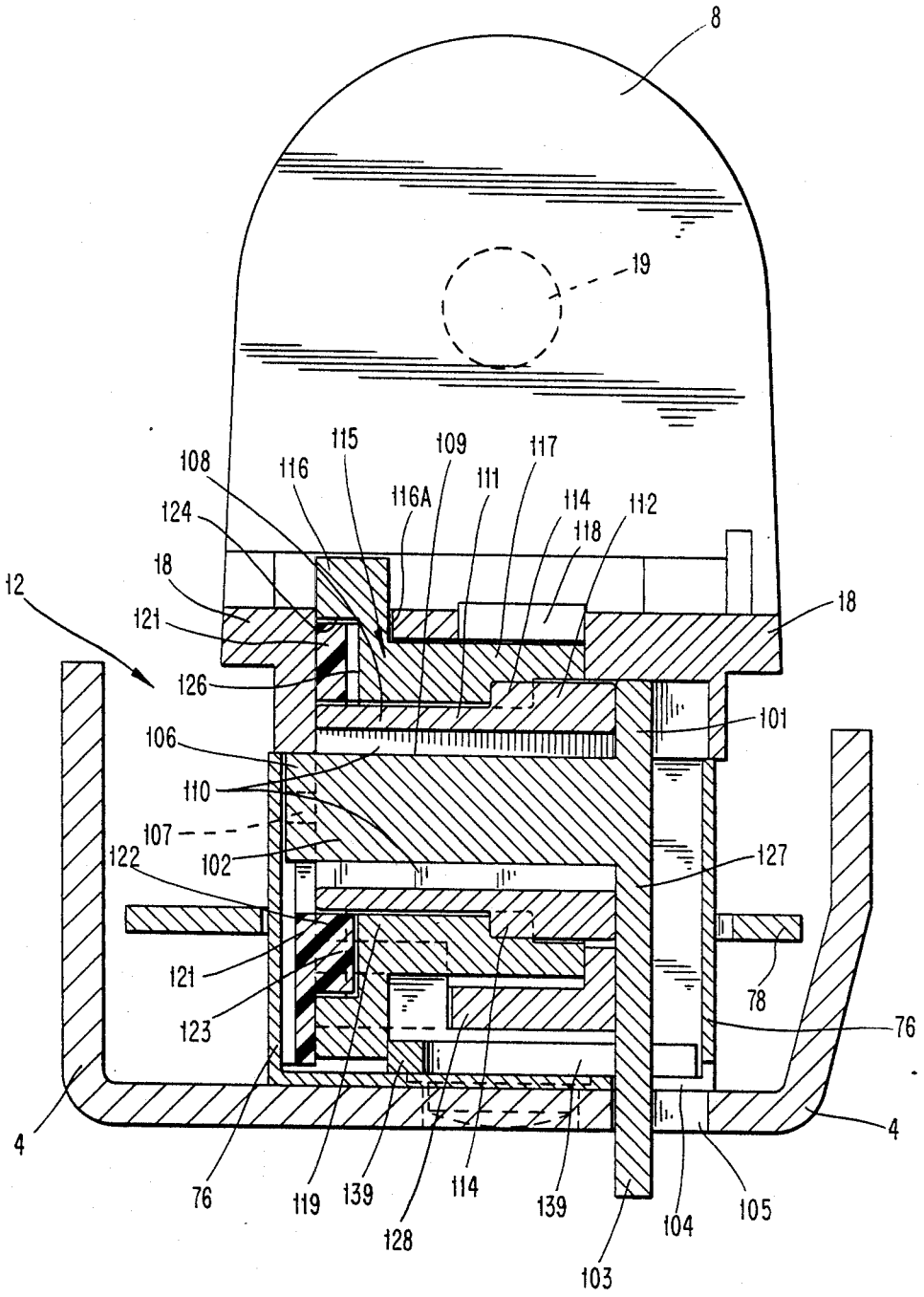
FIG. 12 is a cross-sectional view taken through the center plate with the rotary dials coupled for rotation with the sleeves of the lock.
Figure 13:
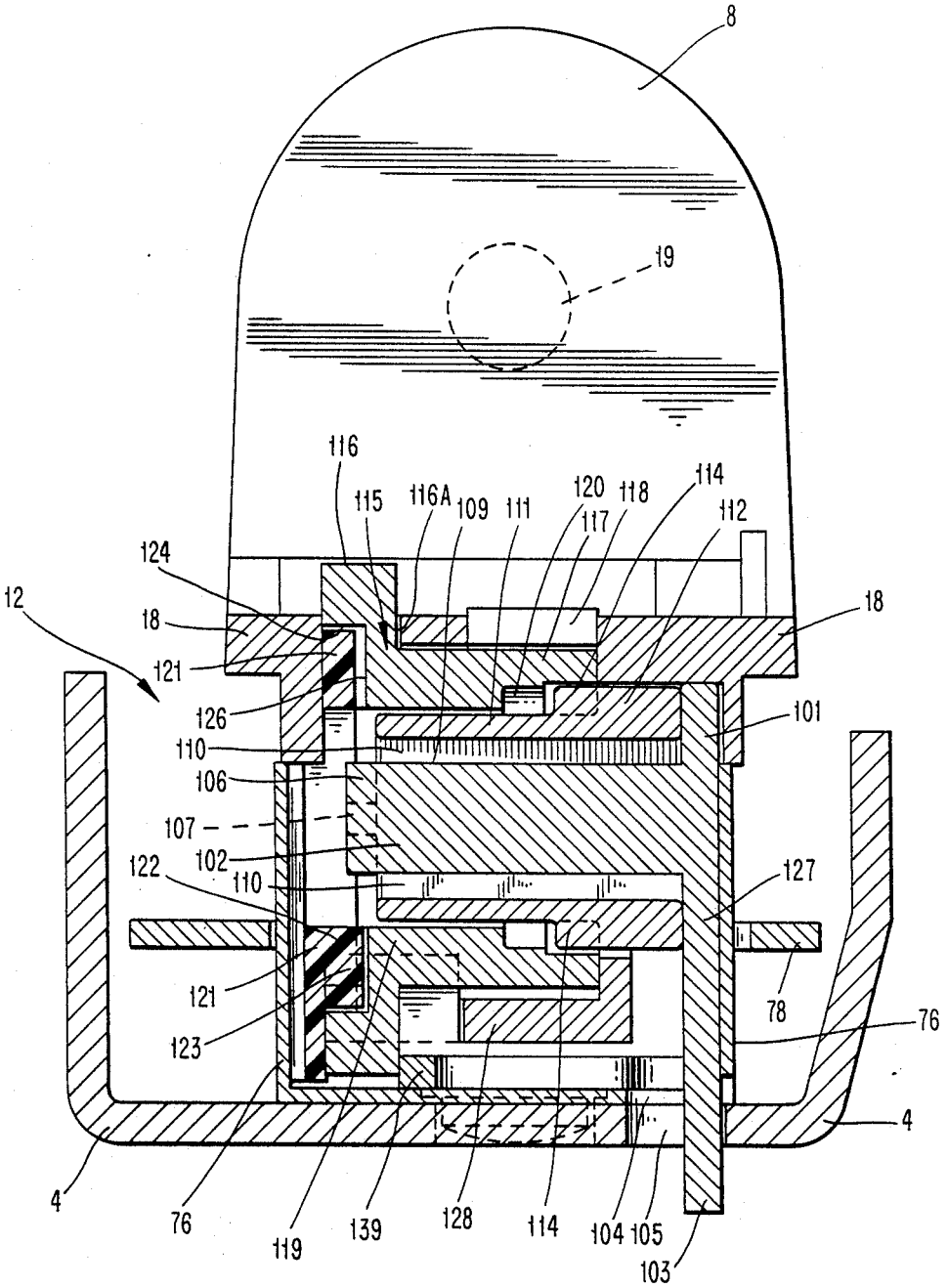
FIG. 13 is a view similar to FIG. 12, after the sleeves have been displaced out of engagement with the dials to enable the combination to be changed.
Figure 14:
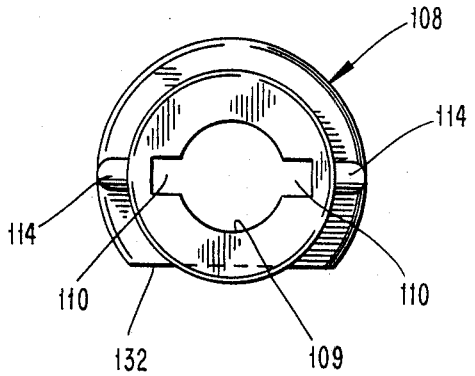
FIG. 14 is a front view of a sleeve.
Figure 15:
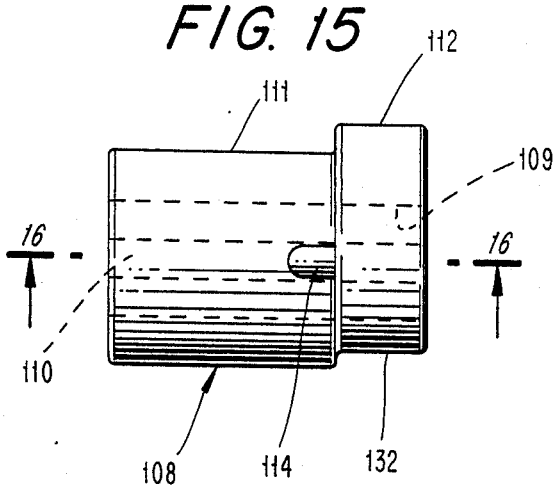
FIG. 15 is a side elevational view of a sleeve.
Figure 16:
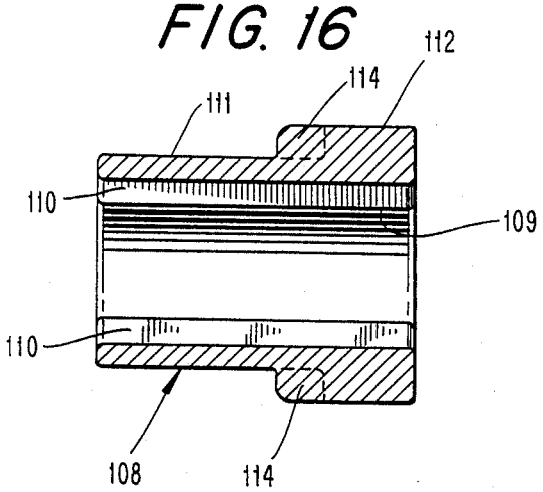
FIG. 16 is a longitudinal sectional view of a sleeve.

The lock 12 includes a carriage 101 which includes a plurality of (preferably three) parallel and spaced apart axle stubs 102 projecting from a wall 127 of the carriage. At a free end 106 of each stub 102 a pair of diametrically opposed, radially extending tabs 107 are provided (see FIG. 8). Mounted on each stub 102 is a sleeve 108 (see FIGS. 14–16). Each sleeve is made hollow by the provision of a center longitudinal bore 109 which includes a pair of diametrically opposed, longitudinal extending slots 110. Each sleeve 108 is installed by aligning the grooves 110 with the tabs 107 of the respective stub and then inserting the sleeve longitudinally over the stub. After the sleeve has passed beyond the tabs 107, the sleeve is rotated so that the tabs lock the sleeve against dislodgement from its stub. Once the carriage 101 has been installed in the housing 76, the sleeves 108 are longitudinally retained between the back wall 127 and the center plate 18 as depicted in FIG. 12. Thus, the sleeves are rotatable on the stubs 102 without any chance of becoming longitudinally dislodged therefrom.

The outer periphery of each sleeve 108 is defined by a bearing section 111 and a coupling section 112 which is of larger diameter than the bearing section 111. The coupling section 112 includes a plurality of circumferentially spaced, longitudinally extending locking projections 114.

Figure 17:
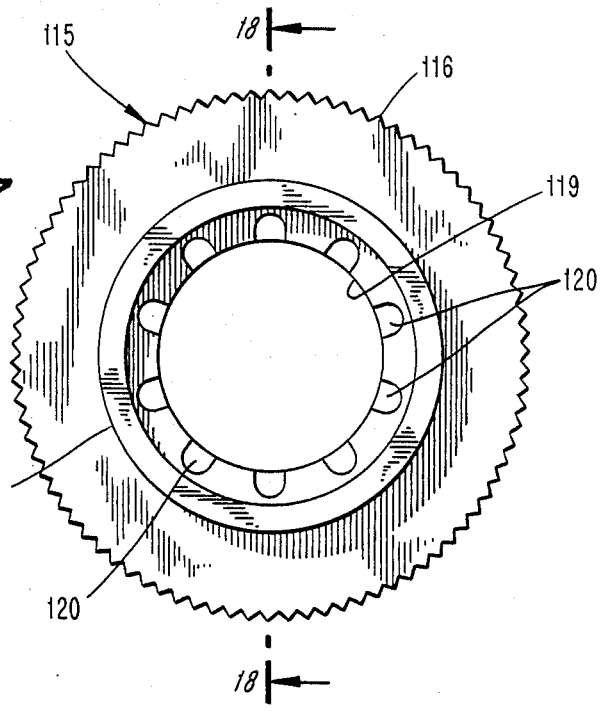
FIG. 17 is a front end view of a dial.
Figure 18:
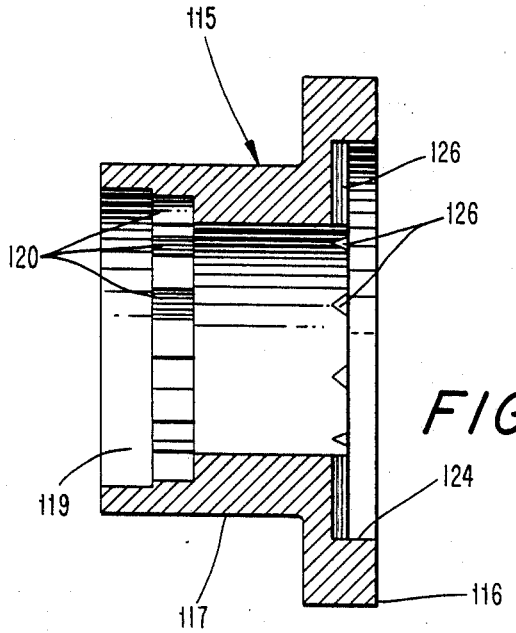
FIG. 18 is a longitudinal sectional view through a dial.
Figure 19:
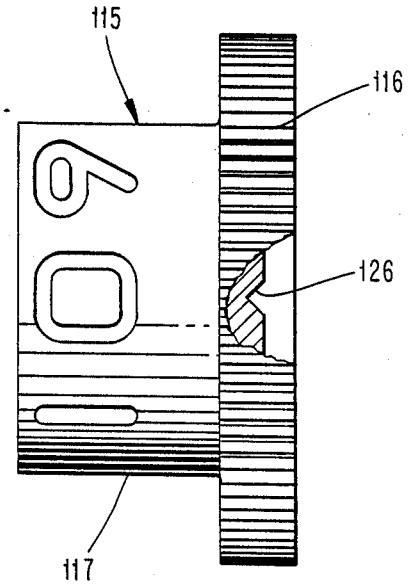
FIG. 19 is a side elevational view of a portion thereof away.

Mounted on the bearing section 111 of each sleeve 108 is a dial 115 (see FIGS. 17–19). Each dial comprises an actuating rim 116 and an indicia surface 117 of smaller diameter than the rim 116. The rim 116 projects through an associated slot 116A in the center plate so as to be accessible for manual actuation by a user. By rotating the dial indicia (such as numbers) carried on the indicia surface 117 can be made visible through a window 118 in the center plate. The dial includes a center bore 119 in which are provided a plurality of circumferentially spaced, longitudinally extending coupling grooves 120 sized to receive the locking projections 114 of the associated sleeve 108, thereby coupling the sleeve to the dial for rotation therewith. The carriage 101 is slidable relative to the dials 115 in a direction parallel to the longitudinal axes of the stubs 102. In that manner, the projections 114 are disconnected from the grooves 120, enabling the dials 115 to be rotated relative to the sleeves 108 in order to change the combination of the lock. In that regard, the carriage 101 includes a depending finger 103 which projects through aligned openings 104, 105 in the housing 76 and frame 4. By manually pushing the finger 103, the carriage 101 is displaced. The tabs 107 on the stubs 102 push the sleeves 108 along with the carriage to uncouple the projections 114 from the grooves 120. The dials 115 are constrained against longitudinal movement with the stubs by portions of the center plate 18.

Figure 20:
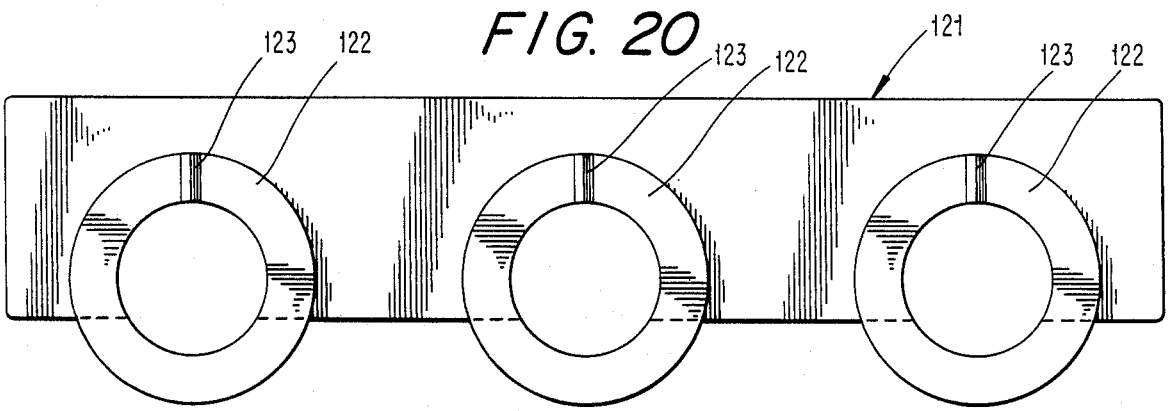
FIG. 20 is a front elevational view of a dial retainer.
Figure 21:
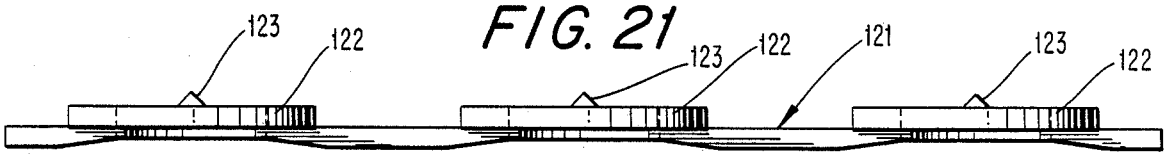
FIG. 21 is a plan view of the dial retainer.

Mounted adjacent the dials 115 is a dial retainer 121 (FIGS. 20, 21) which includes three retainer rings 122 each carrying a cam 123. The rings are arranged to project into recesses 124 formed in the opposing end faces of the dials, whereby the cams 123 engage grooves 126 formed in the dial recesses. The cams thus yieldably hold the dials in each incremental position of dial rotation. The retainer 121 may be formed of a flexible material such as plastic.

Figure 9:
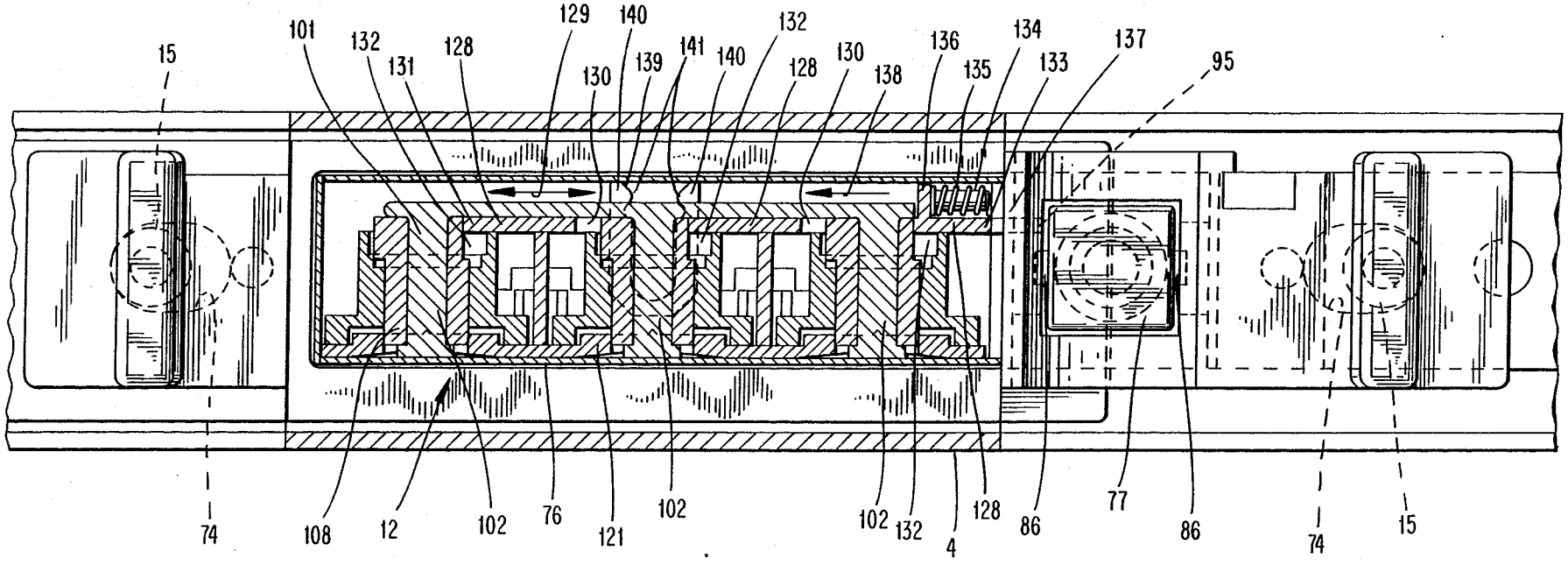
FIG. 9 is a sectional view taken along the line 9—9 in FIG. 8.
Figure 22:
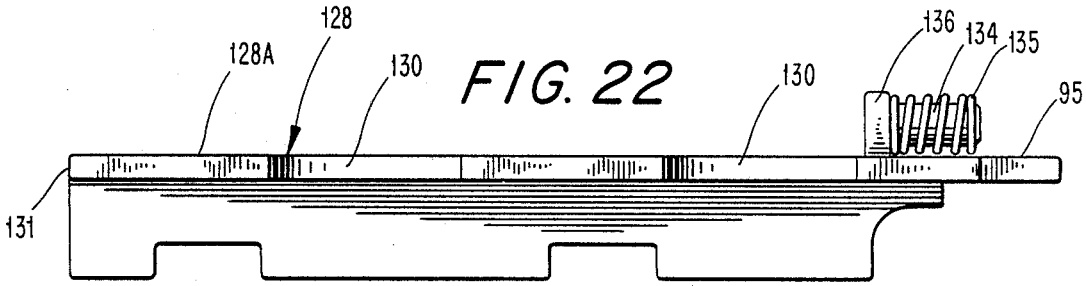
FIG. 22 is a plan view of a bolt.
Figure 23:
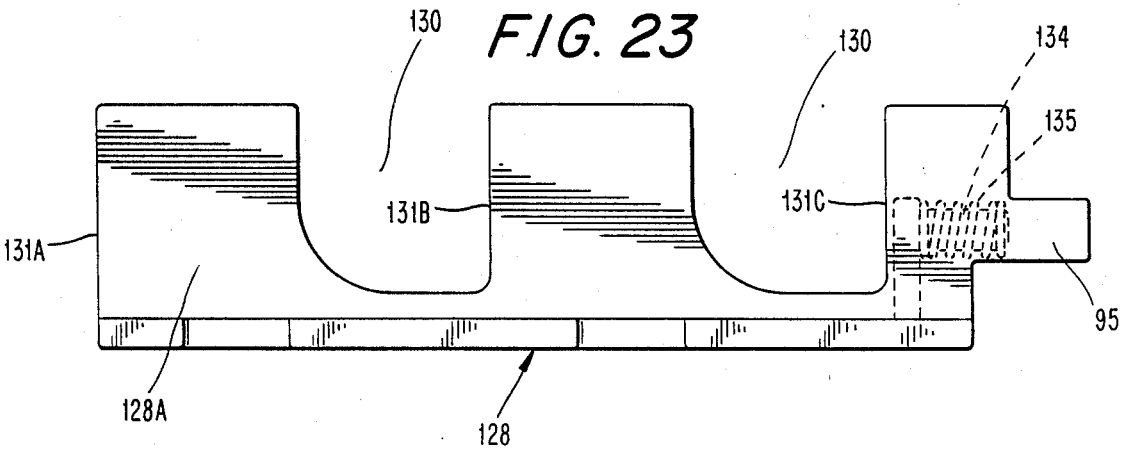
FIG. 23 is a side elevational view of the bolt.

Disposed adjacent the back wall 127 of the carriage 101 is a sliding bolt 128 (see FIGS. 22, 23) which is reciprocable in the direction indicated by the arrow 129 in FIG. 9. The bolt 128 includes a main wall 128A containing two recesses 130 in which two of the sleeves 108 are disposed. An end surface 131A of the main wall 128A is engageable with the remaining sleeve 108, and inner surfaces 131B and 131C of the recesses 130 are engageable respectively with the two sleeves disposed within those recesses. The surfaces 131A, 131B, and 131C define sensing surfaces arranged to engage the coupling sections 112 of the sleeves 108. Each of those outer peripheries contains a flat 132 (see FIGS. 14 and 15). When the sensing surfaces 131A, 131B, 131C engage the flats 132 on all of the sleeves, the lock is in an on-combination condition, and the finger 95 does not block the button 77. If any one of the sleeves is rotated such that the larger diameter portion of the coupling section 112 engages the respective sensing surface, the bolt 128 is displaced (to the right as viewed in FIG. 9) to position the finger 95 in blocking relationship to the button 77. This displacement of the bolt occurs in opposition to the bias of a spring 135 (see FIG. 22) which is mounted on a pin 134 of the bolt. The spring 135 acts against a ledge 136 of the bolt 128 and a wall 137 of the center plate to bias the bolt toward its on-combination position, i.e., in the direction of arrow 138.

Figure 24:
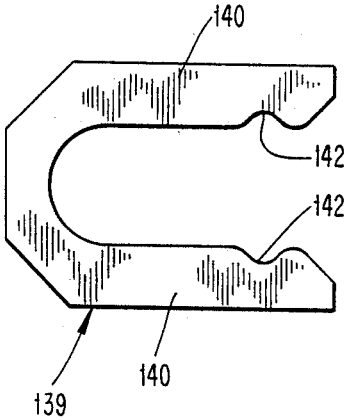
FIG. 24 is a plan view of a U-shaped spring for retaining the sleeve-carrying carriage in two positions.

Disposed in the housing 76 behind the sleeves 108 is a U-shaped spring 139 (see FIGS. 9, 12 and 24) which includes a pair of legs 140 arranged to straddle the finger 103. The legs include recesses 142 which receive the side edges of the finger 103 when the carriage is so oriented that the projections 114 engage the grooves 120 and lock the dial and sleeves for common rotation. The finger 103 can be displaced out of those recesses 142 and past a pair of projections 141 by imposing sufficient force on the finger 103 to spread the legs 140. The carriage will then be held in a position wherein the projections 114 are removed from the grooves 120 to enable the combination to be changed.

Figure 3:
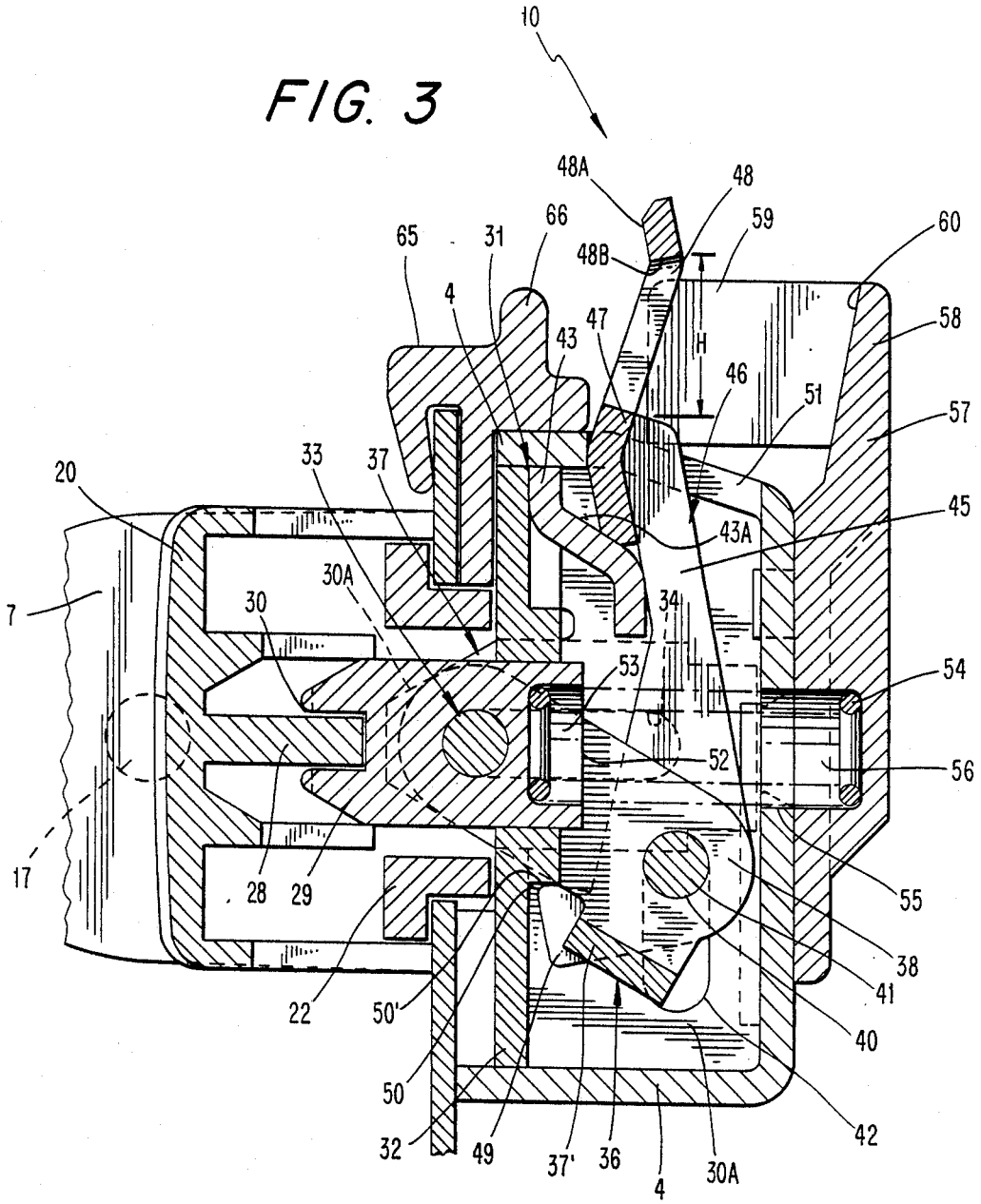
FIG. 3 is a cross-sectional view taken along the line 3—3 in FIG. 2 when the actuating lever is in an open position, and a closure element is in a first of three positions.

THE OPERATION of the closure mechanism will be explained starting with, the case in an open position, and the actuating levers 20 are in an open position as depicted in FIGS. 1 and 3. Also, lock 12 is in an on-combination condition, whereby the finger 95 is retracted out of the path of the button 77 (i.e., the finger 95 is in the position depicted in FIG. 11). To close the case, the sections 2 and 3 are brought together, whereupon the hasp 13 is guided into the hasp-receiving zone in direction D by the guide ramps 59, 60 of the guide plate 57. If the camming ramp 70 is utilized, that ramp will cause the closure element 46 to rotate from a first position (FIG. 3) to a second position (FIG. 4) in which the hook 68 of the hasp is overlapped by the surface 48B of the closure element. The play P between the hook and the drawing surface 48B of the aperture 48 enables the hook 68 to be captured even when the case is so full that the hook does not initially travel all the way to its terminal position in the hasp-receiving zone.

Figure 25:
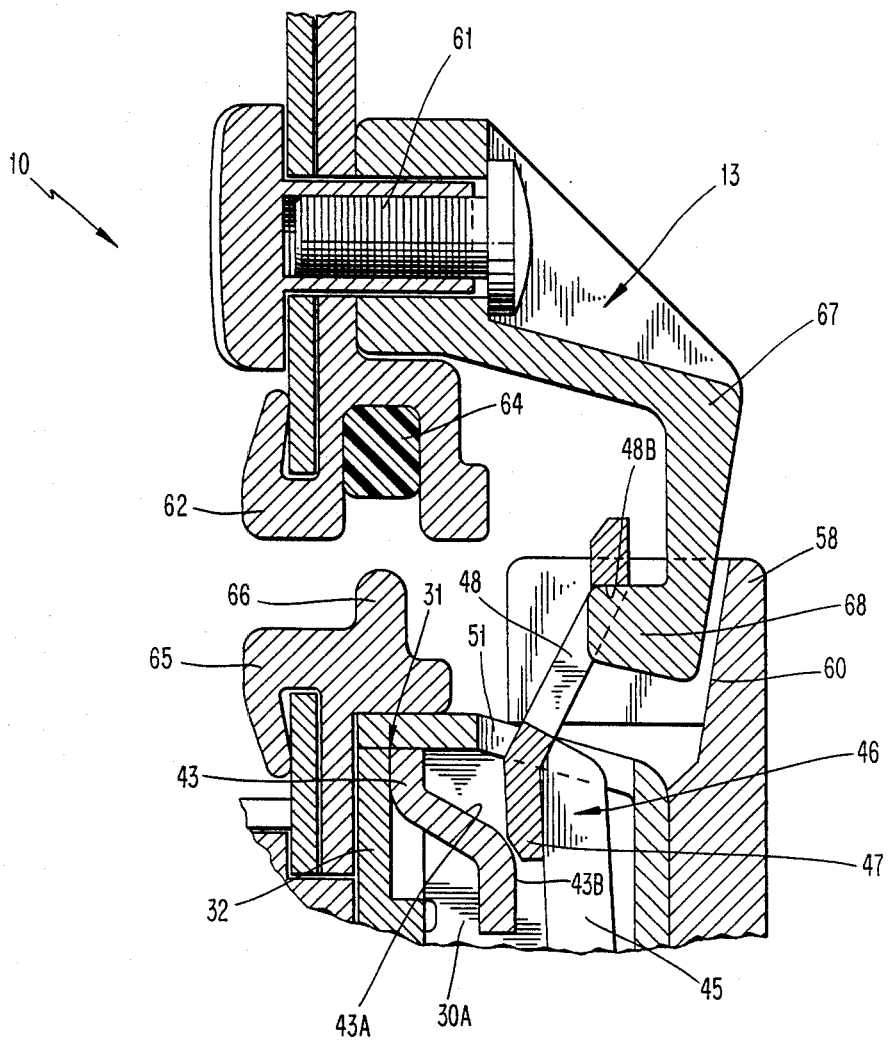
FIG. 25 is a fragmentary view of a modified form of the apparatus according to the invention.

If the camming ramp 70 is not utilized (see FIG. 25), then the closure element 46 will be cammed to its hasp-capturing position by the camming ledge 43 in response to an inward swinging of the actuating lever 20. Also, the play P can be eliminated, if desired, as depicted in FIG. 25.

Thereafter, the actuating levers are swung inwardly to a closed position, against the bias of springs 26, whereupon the slide 29 displaces the force-transmitting member 36. The force-transmitting member thus displaces the pivot axle 41 and the closure element 46 in a direction at least substantially parallel to the direction D to draw the hasp 13 fully to its terminal position in the hasp-receiving zone. Simultaneously, the rib 66 presses against the gasket 64 to create a water-tight seal.

In response to the rotation of the actuating levers 20, the tie rods 73, 78 are displaced such that the recesses 96, 97 in the tie rods become aligned with the fingers 98, 99, respectively, of the center plate 18 and are pushed into mating relationship therewith by the spring 83. This serves to lock the actuating levers 20 against rotation until such time as the button 77 is depressed to force the tie rods 73, 78 off the fingers.

In order to prevent such depression of the button 77, the dials 115 of the lock are scrambled to cause the bolt 128 to be displaced in a button-obstructing direction. That is, until the dials are scrambled, the sensing surfaces 131A, 131B, 131C of the bolt are disposed opposite the flats 132 of the sleeves 108. When the dials are rotated out of the on-combination position, the circular portions of the sleeve surfaces 112 displace the bolt 128 in a direction causing the finger 95 of the bolt to assume a location in front of the button 77 as depicted in FIG. 10. As a result, the button 77 cannot be depressed until the lock is set on-combination to enable the spring 135 to displace the bolt and finger 95 in the direction 138.

In accordance with the present invention, a closure mechanism for a case is provided which facilitates the closing of the case by assuring that the forces applied by the closure element to the hasp are in a direction at least substantially parallel to the direction in which the hasp travels to its terminal position in the hasp-receiving zone. Also, the hasp can be captured by the closure element even when the case is very full. The locking mechanism is very compact and provides for a central unlocking by the push button and a changing of the combination in a simple, reliable manner.

Although the present invention has been described in connection with a preferred embodiment thereof, it will be appreciated by those skilled in the art that additions, modifications, substitutions and deletions not specifically described, may be made without departing from the spirit and scope of the invention as defined in the appended claims.

What is claimed is:

1. In a case comprising a pair of closable sections, a hasp mounted on a first of said sections, and a closure mechanism mounted on a second of said sections for acting on said hasp to secure said sections closed, said closure mechanism comprising:

means defining a hasp-receiving zone, a closure element mounted for movement between:

a first position enabling said hasp to enter said zone in a first direction of travel, a second position in which a drawing surface of said closure element overlaps a portion of said hasp, and a third position engaging said hasp and retaining said hasp in a terminal position of securement in said zone, and manually actuable means for displacing said closure element from said second position to said third position in a second direction substantially parallel to said first direction, said manual actuable means including an actuating lever rotatable about an axis oriented parallel to said second direction.

2. A case according to claim 1, wherein said closure element is rotatable on a pivot axle for movement between said first and second positions.

3. A case according to claim 2, wherein said pivot axle is displaceable between positions corresponding to said second and third positions of said coupling element, said pivot axle being constrained for movement in said second direction, said manually actuable means being operably connected to said pivot axle for effecting displacement thereof in said second direction.

4. A case according to claim 3, wherein said closure mechanism includes guide ramps at said hasp-receiving zone for guiding the entry of said hasp into said zone.

5. A case according to claim 3, wherein said actuating lever is rotatable to an open position for moving said closure element from said third position to said second position, said closure element arranged to engage a stationary shoulder upon reaching said second position to cause said closure element to rotate to said first position.

6. A case according to claim 3 wherein said pivot axle is guided for linear reciprocation in a stationary slot, a linearly displaceable slide being provided, a control lever pivotably connected between said slide and said pivot axle such that displacement of said slide causes said pivot axle to be displaced in said slot, said manually actuable means comprising a pivotably mounted actuating lever displaceable between open and closed positions and arranged to displace said slide in response to being closed, whereby said closure element is displaced from said second position to said third position.

7. A case according to claim 1, wherein said drawing surface of said closure element comprises a surface of an aperture in said closure element into which a projection of said hasp projects.

8. A case according to claim 7, wherein said aperture has a height greater than the height of said projection.

9. A case according to claim 1, wherein said first case section includes a camming ramp for displacing said closure element from said first position to said second position when said case sections are closed together.

10. A case according to claim 1 including guide ramps at said hasp-receiving zone for guiding the entry of said hasp into said zone.

11. A case according to claim 1, wherein said manually actuable means comprises an actuating lever rotatably mounted on said second section.

12. A case according to claim 11 including a tie rod connected to said actuating lever, and a permutation lock for restraining said tie rod when said lock is off-combination, to prevent rotation of said actuating lever to a case-opening position.

13. A case according to claim 12, wherein said permutation lock comprises a carriage including a plurality of axle stubs, a sleeve rotatably mounted on each axle stub, and an indicia dial releasably connected to each sleeve, said carriage and sleeves being displaceable as a unit relative to said dials for changing the combination.

14. A case according to claim 13, wherein said tie rod is releasably engageable with a retainer to prevent rotation of said actuating lever, a push button arranged to release said tie rod from said retainer, said lock including a bolt engageable with said sleeves and being displaceable by said sleeves to a position blocking movement of said push button when said lock is off-combination, said bolt being displaceable by a spring to a position permitting movement of said push button when said lock is on-combination.

15. A closure mechanism for use with a case of the type comprising first and second hinged-together sections, said first section carrying a hasp, said closure mechanism comprising:

means defining a hasp-receiving zone for guiding a hasp in a first direction, a closure element having a drawing surface and mounted for rotation on a pivot axle for rotation between a first position enabling a hasp to enter said hasp-receiving zone, and a second position in which said drawing surface overlaps a portion of said hasp, and manually actuable means for displacing said pivot axle to move said closure element in a second direction substantially parallel to said first direction to a third position in which the drawing surface displaces a hasp to a terminal portion of said hasp-receiving zone, said manually actuable means including an actuating lever rotatable about an axis oriented parallel to said second direction.

16. A closure mechanism according to claim 15, wherein said drawing surface comprises a wall of an aperture formed in said closure element.

17. A closure mechanism according to claim 15, wherein said manually actuable means comprises a pivotably mounted actuating lever swingable to a closed position for moving said closure element to said third position, and a permutation lock operably connected to said actuating lever for preventing said actuating lever form swinging to an open position when said lock is off-combination.

18. In a case comprising a pair of closable sections, a hasp mounted on a first of said sections, and a closure mechanism mounted on a second of said sections for acting on said hasp to secure said sections closed, said closure mechanism comprising:

means defining a hasp-receiving zone, a closure element mounted for rotational and linear movement between:

a first position enabling said hasp to enter said zone in a first direction of travel, a second position in which a drawing surface of said closure element overlaps a portion of said hasp, and a third position engaging said hasp in a terminal position of securement in said zone, and manually actuable means for displacing said closure element form said second position to said third position in a second direction substantially parallel to said first direction, said closure element being rotatable about an axis oriented perpendicular to said second direction, said closure element rotating about said axis during movement between said first and second positions, one of said case sections including a camming surface for engaging and camming said closure element from said first position to said second position.

19. A case according to claim 18 including a shoulder arranged to be engaged by said closure element as the latter approaches said second position from said third position, for causing said closure element to rotate to said first position.

20. In a case comprising a pair of closable sections, a hasp mounted on a first of said sections, and a closure mechanisms mounted on a second of said sections for acting on said hasp to secure said sections closed, said closure mechanisms comprising:

means defining a hasp-receiving zone, a closure element mounted for rotational and linear movement between:

a first position enabling said hasp to enter said zone in a first direction of travel, a second position in which a drawing surface of said closure element overlaps a portion of said hasp, and a third position engaging said hasp and retaining said hasp in a terminal position of securement in said zone, and manually actuable means for displacing said closure element from said second position to said third position in a second direction substantially parallel to said first direction, said manually actuable means comprising an actuating lever rotatably mounted on said second section, a tie rod connected to said actuating lever, and a permutation lock for restraining said tie rod when said lock is off-combination, to prevent rotation of said actuating lever to said case-opening position.

21. Apparatus according to claim 20, wherein said case sections including camming means for camming said closure element from said first position to said second position.

22. Apparatus according to claim 21, wherein said closure element rotates about a pivot axis during movement from said first position to said second position, one of said case sections including camming means for camming said first position to said second position.

23. A closure mechanism for use with a case of the type comprising first and second hinged-together sections, said first section carrying a hasp, said closure mechanism comprising:

means defining a hasp-receiving zone for guiding the hasp in a first direction, a closure element having a drawing surface and mounted for rotation on a pivot axle for rotation between a first position enabling a hasp to enter said hasp-receiving zone, and a second position in which said drawing surface overlaps a portion of the hasp, and manually actuable means for displacing said pivot axle to move said closure element in a second direction substantially parallel to said first direction to a third position in which the drawing surface displaces the hasp to a terminal portion of said hasp-receiving zone, said manually actuable means comprising a pivotably mounted actuating lever swingable to a closed position for moving said actuating lever to said third position, said closure mechanism including a permutation lock operably connected to said actuating lever for preventing said actuating lever from swinging to an open position when said lock is off-combination.

24. A closure mechanism according to claim 23, wherein said actuating lever is rotatable about a pivot axis oriented parallel to said second direction.

25. A closure mechanism according to claim 24, wherein said closure element rotates about a pivot axis during movement from said first position to said second position, said closure mechanism including a camming surface for camming said closure element from said first position to said second position.

* * * * *